United States Patent [19]

Adams

[11] 3,954,038

[45] May 4, 1976

[54] ELECTRICAL MUSICAL INSTRUMENT WITH AUTOMATIC SEQUENTIAL TONE GENERATION

[75] Inventor: Roman A. Adams, Lincolnshire, Ill.

[73] Assignee: Warwick Electronics Inc., Chicago, Ill.

[22] Filed: Nov. 23, 1973

[21] Appl. No.: 418,577

[52] U.S. Cl. ..... 84/1.01; 84/1.03

[51] Int. Cl.[2] ..... G10H 1/00

[58] Field of Search ..... 84/1.01, 1.03, 1.17, 84/1.24

[56] References Cited

UNITED STATES PATENTS

| | | | |
|---|---|---|---|
| 3,235,648 | 2/1966 | George | 84/1.03 |
| 3,518,352 | 6/1970 | Plunkett | 84/1.03 |
| 3,546,355 | 12/1970 | Maynard | 84/1.03 |
| 3,548,065 | 12/1970 | Freeman | 84/1.03 |
| 3,548,066 | 12/1970 | Freeman | 84/1.03 |
| 3,549,776 | 12/1970 | Shiga et al. | 84/1.03 |
| 3,617,602 | 11/1971 | Kniepkamp | 84/1.17 |
| 3,718,748 | 2/1973 | Bunger | 84/1.03 X |
| 3,842,184 | 10/1974 | Kniepkamp et al. | 84/1.24 |

*Primary Examiner*—Ulysses Weldon

*Attorney, Agent, or Firm*—Wegner, Stellman, McCord, Wiles & Wood

[57] ABSTRACT

An electronic organ includes digital circuitry for automatically enabling in a sequential manner a plurality of gates to pass tone signals to a corresponding plurality of keyers. The sequential enabling is separately controllable by an arpeggio circuit, a glissando circuit, and a strum circuit. The digital circuitry includes an octave counter and a tone counter both of which are stepped by a quadrature clock to sequentially enable the gates. The quadrature clock can be stopped to cause a count to be held under control of multivibrators which adjustably control the tone interval and the repeat interval. The repeat multivibrator can be automatically synchronized under control of a key down detector or a rhythm generator.

9 Claims, 4 Drawing Figures

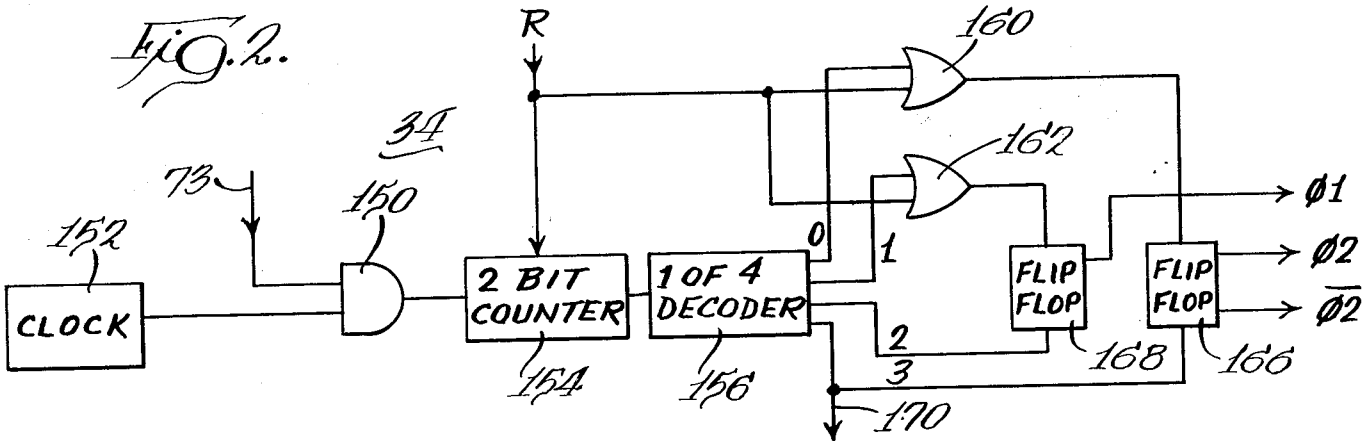
FIG. 2.
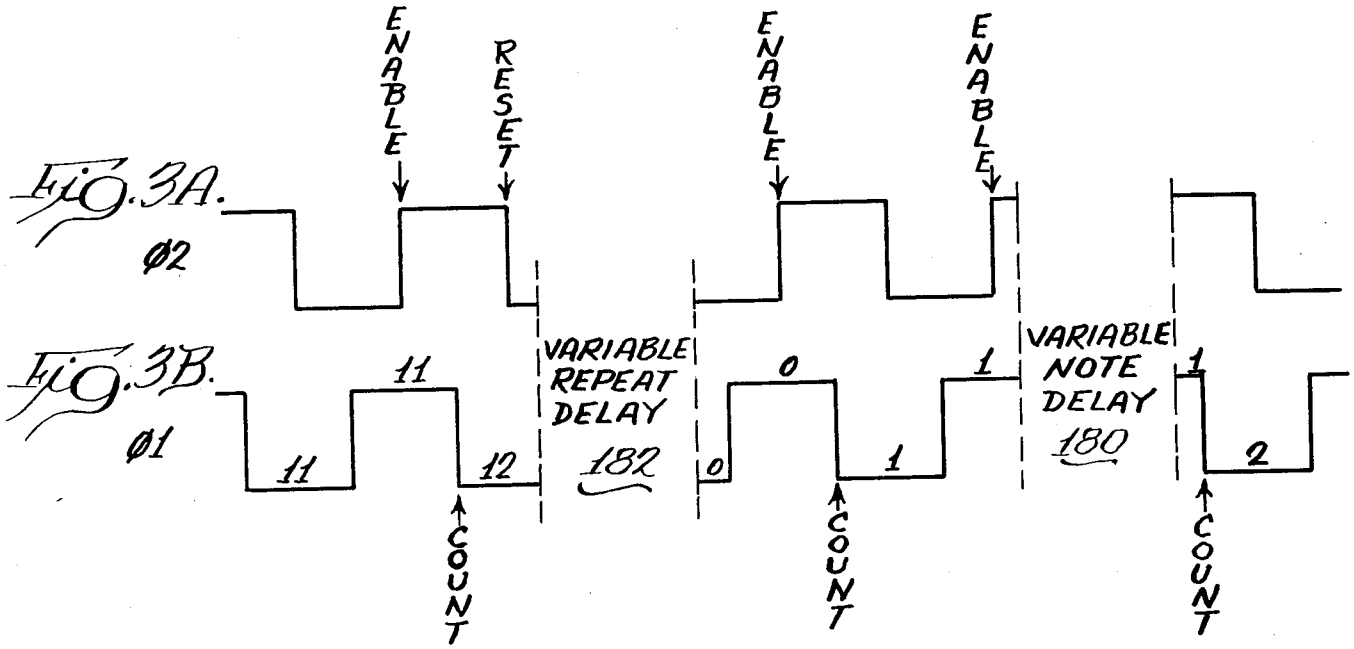
FIG. 3A.
FIG. 3B.

ELECTRICAL MUSICAL INSTRUMENT WITH AUTOMATIC SEQUENTIAL TONE GENERATION

BACKGROUND OF THE INVENTION

This invention relates to an improved electrical musical instrument for automatically producing a sequential series of related tones.

Electronic organs have included circuitry for producing a sequential series of related tones. Such special effects are generally provided only on electronic organs having a lower or accompaniment keyboard manual and an upper or melody keyboard manual. In particular, the execution of an arpeggio, a glissando or a strum musical effect either requires an accomplished organist or automatic circuitry which allows an amateur to accomplish these special musical effects.

Prior electronic organ circuits for automatically producing an arpeggio effect, typically consist of a plurality of gates which are sequentially enabled by an analog circuit to pass tone signals, when present at the gate, to a keyer in order to produce a corresponding audible tone. The arpeggio effect is produced by depressing selected keys of the lower manual, and then actuating an arpeggio switch. The analog circuit then generates a ramp voltage which sequentially enables the gates to cause sequential sounding of the selected tones in the same octave as selected on the keyboard, followed by sequential enabling of the same tones in the next octave, followed by the following octave, until all octaves of the organ have been enabled. The effect is similar to an accomplished organist depressing selected keys of the lower manual, while simultaneously sequentially depressing the same key of the same octave on the upper manual, followed by the sequential depressing of the same keys but in the next octave of the upper manual, and so forth. An example of such a circuit is shown in U.S. Pat. No. 3,617,602 to Kniepkamp.

An automatic glissando is somewhat similar to an automatic arpeggio, except that all notes of each octave are enabled. The effect is that of a skilled organist sequentially playing all notes of the upper manual, from the lowest note to the highest note. If the organ were in a sustain mode, the sequentially enabled notes would be slurred together, producing the effect of a glide rather than a glissando. Heretofore, such an effect could be produced in an automatic arpeggio organ by depressing all keys in an octave, and then actuating the automatic arpeggio switch. The result would be a glissando effect, starting with the lowest frequency note which had been depressed.

A strum effect is produced by the sequentially enabling of a related series of notes in one octave, and repeating the sequential enabling after the lapse of a period of time. The resulting effect simulates the strumming of a guitar. Such an automatic strumming circuit has been provided by an analog switching circuit which has a capacitor for integrating a voltage to initiate a delay interval. An example of such a circuit is shown in U.S. Pat. No. 3,235,648 to George.

Various problems have been encountered with prior circuits for automatic sequential enabling of tones. When many octaves are to be played, the analog ramp for controlling sequential enabling of gates must be very precise, requiring components of extremely limited tolerance. The complexity of prior circuits has not made it possible to combine various sequential musical effects, to provide a single circuit which will produce both a strum and an arpeggio and/or glissando. Another serious problem is that the note interval generally must be the same as the sequential switching interval, producing an unrealistic sound which does not properly simulate the musical effect which is produced by a skilled organist. This problem has been compounded by the necessity for simultaneously actuating several organ controls in order to produce the desired musical effect, which operation is difficult for an amateur organist who desires to be able to simulate a more realistic musical effect.

SUMMARY OF THE INVENTION

In accordance with the present invention, an improved musical instrument includes digital circuitry for producing a variety of musical effects relating to the sequential playing of tones. A plurality of controllable gates can be enabled by a digital counter to sequentially enable tone keyers. The digital counter can be precisely and rapidly stepped through all octaves of the musical instrument, and can be stopped for any selected time interval to allow the playing of a note. This operation allows independent adjustment of the note interval, and of the stepping interval for sequential enabling of gates thereby producing a realistic musical effect. The sequential playing of related tones can be repeated automatically, after the lapse of a selectable time interval. The digital circuitry is of simple design and allows combining of musical effects so that the same musical instrument can for example play an arpeggio, a glissando, and a strum, using many common circuit elements.

One object of the present invention is the provision of an improved electrical musical instrument for automatically producing a related series of tones which are generated in a sequential manner. The sequential generation of tones is produced by digital counting circuitry which allows independent adjustment of the note interval and of the repeat interval for the musical effect.

Other features and advantages of the invention will be apparent from the following description and from the drawings. While an illustrative embodiment of the invention is shown in the drawings and will be described in detail herein, the invention is susceptible of embodiment in many different forms and it should be understood that the present disclosure is to be considered as an exemplification of the principles of the invention and is not intended to limit the invention to the embodiment illustrated.

BRIEF DESCRIPTION OF THE DRAWINGS

FIG. 2 is a schematic diagram of a quadrature clock shown in block form in FIG. 1, and FIGS. 3A and 3B are waveforms of a pair of quadrature outputs produced by the quadrature clock.

GENERAL OPERATION

Figure 1:
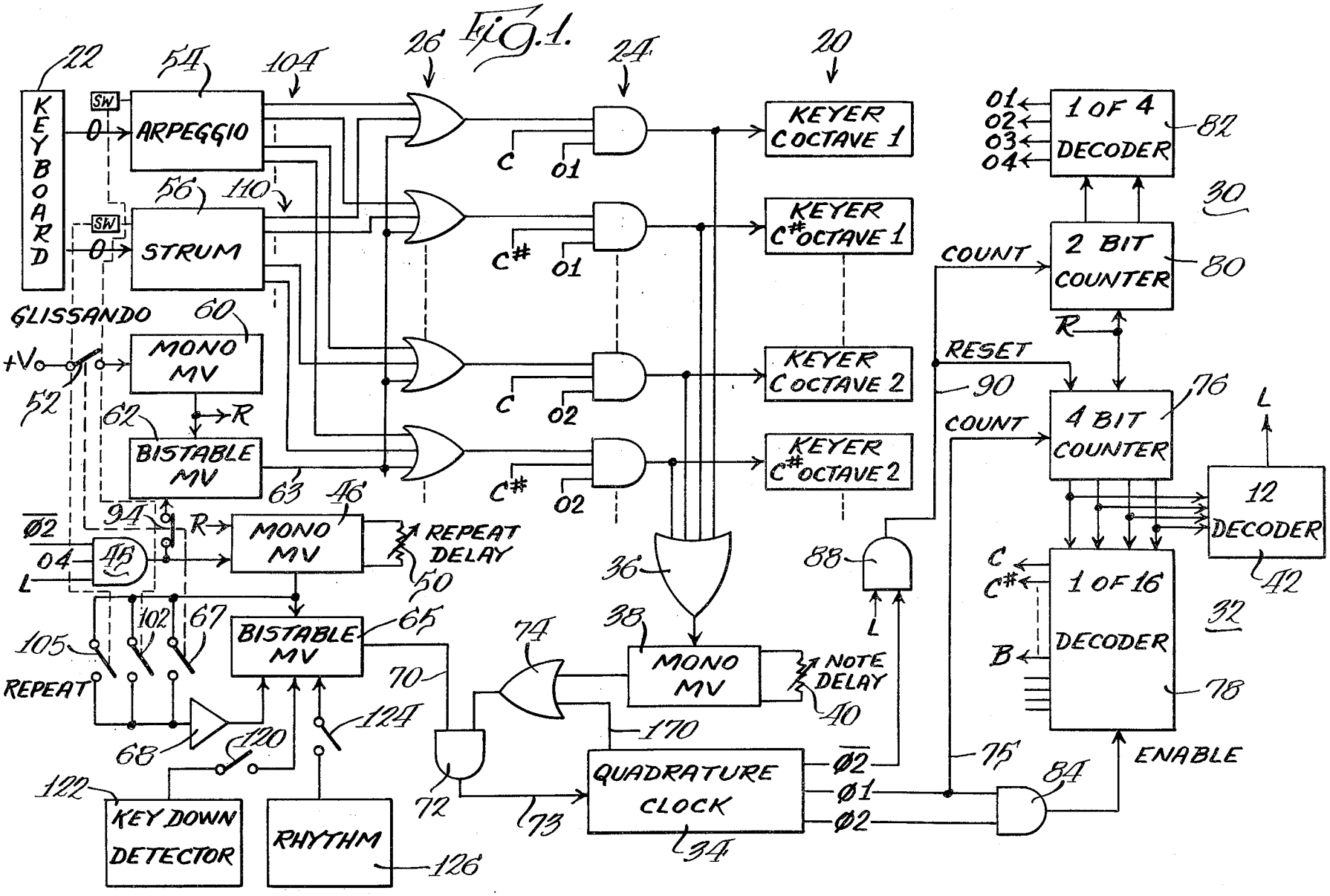
FIG. 1 is a partly block and partly schematic diagram of an electronic organ having digital circuitry for automatic sequential enabling of related tones.

Turning to FIG. 1, an electronic organ or other keyboard electrical instrument includes a plurality of tone producing means such as keyed tone generators or keyers 20 which are each separately actuable to produce a different audible musical tone. By way of example, it will be assumed that the organ has a musical range of 44 notes, and accordingly, there are 44 keyers 20, the first or lowest frequency one of which corresponds to note F of the lowest octave (labeled Octave 1). For clarity, only four of the 44 keyers are illustrated and simulated, only four of the 44 circuits related thereto are shown in detail in FIG. 1. A keyboard 22 of the lower manual has 44 selectable key switches which, upon being actuated by the organist, cause the corresponding keyers 20 to be actuated by means of conventional circuitry (not illustrated in FIG. 1). Similarly, a keyboard for the upper manual and associated conventional circuitry (not illustrated) produces actuation of the keyers 20 when the corresponding selectable keys of the upper manual are depressed.

In order to produce special effects concerning sequential actuation of the keyers, 44 AND gates 24 each have an individual output coupled to an input of the corresponding keyer 20. Each AND gate 24 is enabled only when all three of its inputs have signals corresponding to a "one" binary state. The uppermost of the three inputs receives a binary "one" signal when the particular tone is selected to be played at its proper point in the chromatic scale, from a corresponding one of 44 separate OR gates 26. The inputs to the OR gates 26 are selected in accordance with the special musical effects which are to be produced, as will be explained. The remaining two inputs to the AND gates 24 represent counter signals which allow enabling of each AND gate 24 when a digital counter has stepped to a corresponding position in the chromatic scale of 44 notes which can be produced by the organ.

The digital counter or cycle means for automatic sequential enabling of the AND gates 24 includes an octave counter 30 and a note counter 32. The octave counter has four separate outputs depending on whether the first octave 01 through the fourth octave 04 is then being produced by the counter 30. The note counter 32 has twelve separate outputs labeled F, F sharp, etc. through E, corresponding to the same twelve notes which form an octave. The outputs of the octave counter 30 are coupled to the lowermost inputs of the AND gates 24, whereas the outputs of the note counter 32 are coupled to the middle inputs of the AND gates 24.

The octave counter 30 and the note counter 32 are stepped by the output of a quadrature clock 34. When the circuit is first enabled, the first clock cycle from the quadrature clock 34 causes the octave counter 30 to produce an output on 01, and the note counter 32 to produce an output on line C. This enables two of the three inputs of the uppermost illustrated AND gate 24, thereby causing a tone signal to be passed (if a binary one is now being generated by the particular OR gate 26). Assuming that the particular OR gate 26 is not producing a binary one at this time, the quadrature clock 34 will automatically proceed, after the lapse of a short switching interval, to produce the next clock cycle, which will step only note counter 32 to its next output. This enables line C sharp while line 01 of the octave counter 30 is already enabled at this time. This combination of outputs now allows enabling of the next AND gate 24, illustrated as the second from the top in FIG. 1.

Assuming that a binary zero is being produced by the second illustrated OR gate 26, the quadrature clock 34 will then automatically proceed to cycle to its next output and so will continue to step the note counter 32 until the clock inputs for one octave or twelve gates have been generated. The next cycle will start the note counter 32 over again, and will step octave counter 30 to output 02, and so on until automatically all 44 AND gates 26 have received clock inputs to pass keying signals, should binary one keying signals be present at the top inputs. Since the cycle time of the quadrature clock 34 is very rapid, the generation of gate clock input signals 24 occurs in a very rapid sequence. Furthermore, the clock input signals for gates could be generated in an descending rather than ascending order of the chromatic scale.

When a tone is to be produced at its corresponding position in the chromatic scale, the corresponding OR gate 26 will generate a binary one signal which is passed to the first input of the associated AND gate 24. When the counter 30 and 32 provide the other inputs for that same AND gate 24, the gate will be enabled, the binary one keying signal will be passed to the corresponding keyer 20, and also will be passed to an OR gate 36 (actually several OR circuits) which has inputs for all of the AND gates 24. The binary one signal or sets a monostable multivibrator (MV) 38 into its unstable state with a binary zero signal on its output. The time delay or predetermined period that it takes MV 38 to return to its initial stable state is determined by an RC time constant which is preset by a variable resistor 40.

During the time that MV 38 is energized, its output disables the quadrature clock 34, thus maintaining the counters 30 and 32 at the same count which had caused the note signal to be passed through the now enabled AND gate 24. This causes the same AND gate to continue to be enabled, causing the output binary one to continue to be gated therethrough to the corresponding keyer 20 to continue to sound the audible tone. At the end of the time interval selected by variable resistor 40, the MV 38 returns to its stable state, thereby enabling the quadrature clock 34 to continue to cycle and thus step the counters 30 and 32 to the next step of the chromatic scale. Thus, the time interval selected by variable resistor 40 corresponds to the note delay or note interval, that is, the time period from initiation to termination of the audible note. The note interval is greatly in excess of the cycle time of the quadrature clock 34, and is manually selected by the operator in accordance with the musical effect to be created.

The quadrature clock 34 now cycles the counters 30 and 32, causing rapid sequential enabling of the next AND gate 24 until an AND gate 24 is reached at which a binary one signal is present from the corresponding OR gate 26. The gating of the binary one signal to the corresponding keyer also again passes the binary one signal to the OR gate 36 to enable the MV 38. The MV 38 now disables the quadrature clock 34 and causes the note then being produced to continue to sound until the lapse of the note interval as controlled by the variable resistor 40. As the MV 38 returns to its stable state, the quadrature clock 34 then continues to sequentially cycle and hence enable the AND gates 24.

The free running time interval of sequential enabling of the AND gates 24 by the counters 30 and 32 is chosen to be much shorter than the note interval produced by variable MV 38. As a result, the audible effect to the organist is that the next selected note appears to be immediately or instantaneously sounded after termination of the prior selected note (assuming that the electronic organ is not in the sustain mode).

Each time after the note counter 32 has stepped through the twelfth note, a decoder 42 detects the prestepping of the note counter 32 to what would be the 13th note (which corresponds to digital number 12 since the first output C is produced in response to a 0, 0, 0, 0 binary input). This produces an output L representing that the last note of an octave has been enabled. When the L output occurs simultaneously with the last or 04 output of the octave decoder 30, then at a particular portion of the cycle of the quadrature clock 34, all enabling inputs for AND gate 45 are present. This produces an end of scale output signal which actuates a multivibrator MV 46 to generate a disabling signal for the quadrature clock 34.

The time that it takes the MV 46 to return to its initial stable condition is determined by an RC time constant which may be preset by the value of a variable resistor 50. The actuated interval of the MV 46 corresponds to the repeat delay or repeat interval which must elapse before the selected musical effect begins an entire new cycle of operation. During the repeat interval, while MV 46 is enabled, the quadrature clock 34 is stopped and the octave counter 30 and note counter 32 are simultaneously set to zero states. After the lapse of the repeat interval, the output of the MV 46 allows enabling of the quadrature clock 34 if other circuits to be described hereinafter have conditioned the system to repeat the same musical effects.

Assuming a repeat has been selected by the musician, the quadrature clock 34 is now allowed to continue cycling and counters 30 and 32 now being again to sequentially enable the AND gates 24. This causes the previously described cycle of operation to occur, in which the controlled gates 24 are rapidly enabled until reaching a selected note, and then remain energized during the note interval as controlled by the variable resistor 40. Upon the lapse of the note interval, the quadrature clock 34 is again released for operation, and the counters rapidly proceed to sequentially enable the AND gates 24 until reaching the next AND gate at which a note is to be sounded.

Three types of automatic sequential enabling of notes are provided by the applicant's system. The actuation of a glissando switch 52, an arpeggio switch 191, or a strum switch 192, will cause notes to be passed by the OR gates 26 in accordance with a glissando, an arpeggio, or a strum effect. The operation of the system will now be described in more detail with reference to these special effects, it being understood that most of the system is utilized in common by all three of the special effect circuits.

DETAILED OPERATION OF SYSTEM INCLUDING AUTOMATIC GLISSANDO

The detailed operation of FIG. 1 will now be described assuming that an automatic glissando effect is to be produced. The glissando switch 52 is closed, thereby enabling a monostable multivibrator MV 60 which eliminates spurious signals due to key bounce. The MV 60 produces a reset output signal R to reset the counters 30 and 32, and also sets bistable MV 65 to enable quadrature clock 34 by means of AND gate 72. A binary one signal is generated on output line 70 when bistable MV 65 is set. At the same time, the output from the MV 60 also actuates the set input of a bistable multivibrator MV 62. An output line 63 of the bistable MV 62 then generates a binary one signal which remains until MV 62 is reset, which does not occur until after all 44 AND gates 24 have been enabled. The output line 63 has an input to each of the 44 OR gates 26, thus passing binary one signals to all of the AND gates 24.

Bistable MV 65 is initially set by the R input from Mono MV 60. After $\overline{\phi 2}$, 04 and L enable AND gate 45, Mono MV 46 will begin to time a repeat delay interval. After the lapse of the delay interval, as selected by variable resistor 50, the MV 46 returns to its stable state, thereby producing a negative going edge. The negative going edge is passed through closed switch 67 which is ganged to switch 52 and inverter 68 and resets the MV 65. Thus, the resulting output pulse on a line 70 from MV 65 corresponds in duration and timing to the pulse produced by MV 46, provided that switch 67 (or one of the other switches in parallel therewith) is closed. Switches 67 and 52 are momentary switches and therefore the operator must continuously depress them for a repeat effect.

Output line 70 is coupled to an AND gate 72 which has an output 73 for disabling the quadrature clock 34. The other input of the AND gate 72 is from an OR gate 74 which has an input line from the MV 38. When the MV 65 is triggered by the pulse through switch 67, the output on line 70 causes AND gate 72 to produce a disabling output on line 73, thereby terminating or stopping the operation of the quadrature clock 34. After the lapse of the repeat interval, both MV 46 and MV 65 will change state, terminating the disabling signal on line 73 in order to allow free running of the quadrature clock 34. The quadrature clock 34 has a generally square wave output $\phi 1$ and a second generally square wave output $\phi 2$ which is phase offset by 90° or in quadrature with $\phi 1$. A negated $\phi 2$ output is also available as a square wave $\overline{\phi 2}$.

Output $\phi 1$ is coupled through a line 75 to the count input of a 4 bit counter 76 forming a part of note counter 32. Four binary output lines from counter 76 are coupled to a 1 of 16 binary to digital decoder 78, which may be a conventional item, and which forms a part of the note counter 32. The prior reset operation has produced a binary output (0, 0, 0, 0) from counter 76 which is decoded, at a later time in the clock cycle, to energize the first output line F, corresponding to the lowest frequency note F, from decoder 78.

The octave counter 30 consists of a 2 bit counter 80 having a two binary output line which is coupled to a 1 of 4 binary to digital decoder 82. At this time, the 2 bit counter 80 also is in its reset condition, causing decoder 82 to energize the 01 line, corresponding to the first octave.

At a later portion of the clock cycle, both outputs $\phi 1$ and $\phi 2$ have binary one signals thereon; which are detected by an AND gate 84 to generate an enable output which now enables decoder 78. Output line C is now enabled, so that the first AND gate 24 now has enabling inputs C and 01 and also has a note signal from its corresponding OR gate 26 (due to energization of the glissando line 63). The note signal is passed by the first AND gate 24 to the corresponding keyer C for Octave 1, thereby sounding note C in the lowest octave of the organ. Simultaneously, the note signal is passed through OR gate 36 and energizes the MV 38, producing a triggering signal which causes AND gate 72 to generate a disable output on line 73. The quadrature clock 34 is now instantaneously stopped.

After the lapse of the note interval as controlled by variable resistor 40, the quadrature clock 34 is released and a new cycle starts. This steps counter 76 to its next binary state, causing decoder 78 to have an output on line C sharp when enabled by AND gate 84. The next keyer C sharp for Octave 1 is now enabled since its OR gate 24 also passes a tone signal. Again, the note signal is passed by OR gate 36 and the quadrature clock 34 is stopped only for the duration of the note interval.

The digital circuit continues to operate in the above manner, sequentially producing each of the twelve notes in the first octave. After the highest frequency note E is produced, the quadrature clock 34 causes the counter 76 to count to its thirteenth state which is represented by digital number 12 since counter 76 has stepped from 0 through 11. The presence of digital number 12 is detected by the decoder 42, producing output $\overline{L}$ which is coupled to an AND gate 88. When output $\overline{\phi 2}$ goes positive (which occurs prior to $\phi 1$ and $\phi 2$ going positive), the AND gate 88 generates an output which is coupled via a line 90 to the reset input of counter 76 to restart counter 76 and to the count input of the counter 80 to step decoder 82 to 02.

The above operation continues for all octaves until the 44th note has been sounded. Thereafter, the decoder 42 will again produce an L output. A short time later $\overline{\phi 2}$ goes positive and thus all enabling inputs are now present at the reset AND gate 45. This produces an output which sets MV 46, and also passes an output to a switch 94 which is ganged to the glissando switch 52. The operation now depends on whether the glissando switch 52 is still enabled.

Firstly, it will be assumed that the organist has opened the glissando switch 52 during the above described operation of the glissando circuit. The opening of the glissando switch will have no effect until after the 44th note has been played. Upon actuation of AND gate 45, a signal is passed through the now closed switch 94 to the reset input of MV 62. The MV 62 now switches back to the state which disables the glissando line 63. During this same time, the output from AND gate 45 has enabled MV 46, producing a positive going edge which triggers MV 65 and thereby disables the quadrature clock 34. At the lapse of the delay interval, preset by variable resistor 50, a negative going edge is produced, but MV 65 is not reset since switch 67 is now open. Thus, MV 65 continues to generate an output which disables the quardature clock 34, preventing a new cycle of operation from being started.

Secondly, it will be assumed that the operator wishes the glissando effect to repeat, and therefore the glissando switch 52 will still be closed. At the end of the 44th note the output from AND gate 45 would not reset MV 62 because switch 94 would now be open. As a result, MV 62 would continue to generate the note signal on the glissando line 63. The output of AND gate 45 would also trigger the MV 46, thereby disabling the quadrature clock 34, for the repeat interval. At the end of this interval, MV 46 would return to its stable state, generating a negative going pulse which would now be passed by the still closed switch 67 and inverted by NOT gate 68 to reset MV 65. This terminates the disabling input to quadrature clock 34, causing a new cycle to begin in the same manner as previously described.

AUTOMATIC ARPEGGIO AND STRUM OPERATION

The operation of the arpeggio circuit 54 and the strum circuit 56 will generally be apparent from the above described operation of the glissando circuit. To actuate an arpeggio operation, the organist enables a switch 191 in the arpeggio circuit 54 which also closes a repeat switch 102. At this time, the lower manual keyboard 22 is interconnected with note enabling lines 104 in the manner of an arpeggio. That is, each note on the keyboard 22 enables all output lines 104 corresponding to the same note, for the octave being depressed and for all higher octaves. For example, when the key switch for note C is depressed on keyboard 22, the arpeggio circuit 54 enables output lines 104 which are coupled to the OR gates 26 associated with note C in octave 1, note C in octave 2, note C in octave 3 and note C in octave 4. Normally, several related notes in an octave are depressed at the same time, corresponding to a chord which was to be played in an arpeggio manner.

The operation would then proceed in generally a similar manner as described for glissando, except that note signals would be passed only for the actuated AND gates 24. When the counters 30 and 32 energize and AND gate having a binary one signal applied thereto from a gate 26, a note will be sounded by the corresponding keyer 20 and MV 38 will be enabled in order to hold the note for the note interval as controlled by variable resistor 40. At the end of the note interval, quadrature clock 34 will continue to cycle and will step the counters until the next AND gate 24 is reached which has a binary one signal coupled thereto from a gate 26. This gate may be located several gates away from the last sounded gate. However, the cycling occurs so fast that the note will appear to the ear of the organist to have been generated immediately after termination of the previous note.

After completing stepping through all possible 44 notes, the circuit will then shut down if the arpeggio switch has been opened, or will continue through a new arpeggio mode if the arpeggio switch has remained closed. The closure of the arpeggio switch also closes the repeat switch 102, thereby allowing the MV 65 to be reset in order to begin a new operation of the quadrature clock 34.

The strum circuit 56 operates to interconnect the keys of the keyboard 22 only to the output lines 110 corresponding thereto. The strum circuit causes the selected notes to be repeated only for the same octave, and not the higher octaves. When a strum switch 192 is closed, the depressed keys of keyboard 22, are coupled to output lines 110 corresponding only to the same depressed keys. After lapse of the repeat interval, the quadrature clock 34 is released for free-running and counters 30 and 32 step in a sequential manner, thereby sequentially enabling only the selected notes. After the last selected note has sounded, the quadrature clock 34 is again released and rapidly steps the counters through the remaining unselected notes of the scale.

Assuming that the strum switch has been left enabled, a repeat switch 105 remains closed. After completing stepping through the 44th AND gate 24, the output of AND gate 45 now enables the MV 46. The repeat interval control 50 now operates to control the time interval between strumming of notes.

It may be desirable to synchronize the initiation of the special effect cycle with a musical effect being produced by the organ, rather than by lapse of a time interval controlled by variable resistor 50. For this reason, MV 65 has additional reset inputs which are coupled to other organ circuits. One reset input is coupled through a switch 120 to a conventional key down detector 122, and another reset input is coupled through a switch 124 to a conventional rhythm circuit 126. When the switch 120 is closed, the organist depresses the keys when the next strum is to be initiated. The key depression is detected and resets MV 65 in order to release the quadrature clock 34. In a similar manner, switch 124 may be closed so that detection by circuit 126 of a particular portion of rhythm will reset MV 65 and thereby release the quadrature clock 34. Thus, the automatic repeat of the same special effect will not being until a key down signal, or a rhythm signal, is generated by the organ.

DETAILED OPERATION OF QUADRATURE CLOCK

The circuit forming the quadrature clock 34 is shown in detail in FIG. 2 and will now be explained with reference also being made to FIG. 3 which shows the outputs of the quadrature clock. Disabling input 73 is coupled to an AND gate 150 which blocks or passes pulses from a free running clock 152 to a two bit counter 154. The frequency of clock 152 is chosen to allow the system to rapidly sweep through all controlled gates so that adjacent tones sound, to the ear of the listener, as occurring immediately after termination of the prior tone. Illustratively, the clock 152 may have a frequency such as 2 KHz. The AND gate 150 is enabled to pass clock pulses when neither MV 38 now MV 65 of FIG. 1 has been triggered into a state in which a binary 0 signal is provided on its output. The clock pulses are counted in the two bit counter 154 and control a 1 of 4 binary to digital decoder 156. A zero (0) output line of decoder 156 is coupled to an OR gate 160, and the one (1 ) output line is coupled to an OR gate 162, both of which have an additional input from the reset line R.

The output of OR gate 160 is coupled to the set input of a flip flop 166, whereas the output of OR gate 162 is coupled to the set input of a flip flop 168. The two (2) output of decoder 156 is coupled to the reset of flip flop 168, and the three (3) output is coupled to the reset of flip flop 166, and also is coupled via a line 170 to the OR gate 74 of FIG. 1. Line 170 forms a lock-out to insure that the OR gate 74 does not pass noise pulses or slivers during the portion of the clock time during which no signal should be present to the other input of OR gate 74.

The operation of the quadrature clock 34 may be understood with reference to FIGS. 3A and 3B which show the $\phi 2$ and $\phi 1$ outputs, respectively, of the quadrature clock. As the $\phi 1$ output, FIG. 3B, has a negative going edge, labeled COUNT, the counter 76 of FIG. 1 counts the $\phi 1$ signal on line 75. Later in the cycle, $\phi 2$ goes positive when $\phi 1$ is positive which event is labeled ENABLE and is recognized by AND gate 84 of FIG. 1 to cause enabling of decoder 78. This causes the binary one signal to be passed to an appropriate keyer, if a binary one signal is present at this time at the enabled AND gate 24. When a binary one is present (illustrated as corresponding to note F), the MV 38 is triggered shortly after ENABLE, as indicated by variable note delay or interval 180 (not to scale), which interval is greatly in excess of the illustrated cycle time and is controlled by variable resistor 40. The quadrature clock is now stopped with $\phi 1$ and $\phi 2$ both positive, until the MV 38 returns to its stable state. At this time, the cycle continues with the counter 76 being stepped to its next state or count on the negative going edge of $\phi 1$.

On each repetitive thirteenth cycle of $\phi 1$, (which corresponds to digital number 12), the counter 76 is stepped to state 12 by the negative going edge of $\phi 1$, labeled COUNT. As $\phi 2$ now goes negative (that is, $\phi 2$ goes positive), which is labeled RESET, the AND gate 45 detects the end of the octave and generates the reset signal. This triggers MV 46, thereby enabling the variable repeat delay or interval 182 (not to scale). This stops the quadrature clock 34, with both $\phi 1$ and $\phi 2$ negative. Upon returning of MV 46 to its stable state, MV 65 is reset and the quadrature clock is released, causing the interval 182 to terminate and beginning a new octave cycle of operation. If the circuit has not been set to repeat, MV 65 is not reset when MV 46 returns to its stable state, and hence the quadrature clock remains stopped in the condition with $\phi 1$ and $\phi 2$ negative. Thus, the variable repeat delay 182 will continue, perhaps for extremely long time period, until a repeat operation is to be performed with respect to some special effects.

Having described the invention, the embodiments of the invention in which an exclusive property or privilege is claimed are defined as follows:

1. An electrical musical instrument comprising:

a plurality of tone producing means each actuatable to produce a different tone;

selection means for producing a number of signals representing a corresponding number of the tone producing means which are to be actuated;

a plurality of plural input gates each actuatable when signals are present at the plural inputs thereof, each gate having one input coupled to the selection means and an output coupled to a different one of the plurality of tone producing means for actuation thereof;

cycle means coupled to the other inputs of the gates for generating signals which will actuate in sequence the plurality of gates when signals are also present at the one inputs thereof; and tone interval means including a monostable multivibrator effective to stop the cycle means when any one of said gates is actuated to maintain actuation thereof for a predetermined period, said predetermined period of time being the same for each of said gates whereby the different tones produced are of substantially equal duration.

2. The electrical musical instrument of claim 1 including an adjustable element connected to said monostable multivibrator for changing the duration of the unstable state of said monostable multivibrator.

3. An electrical musical instrument comprising:

a plurality of tone producing means each actuatable to produce a different tone;

selection means for producing a number of signals representing a corresponding number of the tone producing means which are to be actuated;

a plurality of plural input gates each actuatable when signals are present at the plural inputs thereof, each gate having one input coupled to the selection means and an output coupled to a different one of the plurality of tone producing means for actuation thereof;

cycle means coupled to the other inputs of the gates for generating signals which will actuate in sequence the plurality of gates when signals are also present at the one inputs thereof;

tone interval means responsive to the signals from the plural input gates having an adjustable note delay control for controlling said cycle means to maintain actuated for a first adjustable period each gate which has signals present at the plural inputs thereof; and repeat interval means including means connected with the cycle means for detecting completion of the sequence for all of the plurality of gates, and means responsive to detection of sequence completion for disabling the cycle means for a second adjustable period, the lapse of the second adjustable period allowing the cycle means to initiate a repeat cycle.

4. The electrical musical instrument of claim 3 wherein said selection means comprises a keyboard for producing said number of signals, switching means for distributing the number of signals to preselected ones of said plurality of gates, a key down detector for detecting when any of said number of signals is being produced, and means connected with the key down detector for terminating the disabling operation of the repeat interval means in response to detection of any of said number of signals to thereby shorten the second adjustable period.

5. The electrical musical instrument of claim 3 wherein said selection means includes a keyboard for producing said number of signals, switching means for distributing the number of signals to the preselected ones of said plurality of gates, rhythm means responsive to a predetermined rhythm condition for terminating the disabling operation of the repeat interval means to thereby shorten the second adjustable period.

6. An electrical musical instrument comprising:

a plurality of tone producing means each producing an audible tone in response to a tone signal;

a plurality of gates each coupled to a different one of said plurality of tone producing means and each being enabled to pass the tone signal to a corresponding tone producing means;

counter means having a plurality of output lines respectively coupled to said plurality of gates for enabling individual gates when the count corresponds thereto;

clock means coupled to said counter means for generating clock pulses which cause the counter means to count; and means including a monostable multivibrator responsive to a tone signal being passed from any of said plurality of gates for causing the clock means to hold a particular clock pulse for a predetermined period of time and thereby maintain enabling of one of the gates, the predetermined time period of holding being the same for all of the clock pulses held.

7. The electrical musical instrument of claim 6 wherein said causing means includes repeat means operable for stopping the clock means after enablement of all gates to prevent the repeat of a new cycle of sequential enablement of the gates, and variable means including means for establishing an adjustable time period and means for automatically terminating operation of the repeat means to begin a new cycle after the lapse of said adjustable time period.

8. An electrical musical instrument comprising:

a plurality of groups of tone producing means respectively associated with a plurality of octaves, tone producing means of each group being actuable to respectively produce the different notes of an octave associated with that group, a tone producing means in any one group being actuable to produce the same note as a corresponding tone producing means in any other group but in a different octave;

a plurality of groups of gates respectively coupled to the corresponding plurality of groups of tone producing means, each gate being individually actuable to actuate a corresponding tone producing means;

sequence means having a plurality of output lines each coupled to a different one of said gates for enabling individual actuation thereof when the sequence of the sequence means corresponds thereto;

selected control means for actuating in sequence selected gates in one group when actuation is enabled by the sequence means to produce a sequential series of notes in one octave; and a glissando switch, a bistable multivibrator responsive to actuation of said glissando switch for generating on a glissando line an enabling signal, and means for coupling said glissando line to all of said gates in order to actuate each gate, beginning from a selected gate, when actuation is enabled by the sequence means.

9. The electrical musical instrument of claim 8 wherein said selected control means includes a keyboard for selecting tones to be produced, and an arpeggio circuit responsive to selected tones for actuating in sequence gates corresponding thereto in the same octave, when so enabled by the sequence means, and for thereafter actuating in sequence gates corresponding thereto in higher octaves, when so enabled by the sequence means.

* * * * *